US010643558B2

(12) United States Patent
Su et al.

(10) Patent No.: US 10,643,558 B2
(45) Date of Patent: May 5, 2020

(54) DRIVING METHOD OF DISPLAY PANEL, DISPLAY PANEL AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Guohuo Su, Beijing (CN); Zhihua Sun, Beijing (CN); Yujie Gao, Beijing (CN); Shulin Yao, Beijing (CN); Baoyu Liu, Beijing (CN); Xu Zhang, Beijing (CN); Weichao Ma, Beijing (CN); Zhihao Zhang, Beijing (CN); Wenkai Mu, Beijing (CN); Yingmeng Miao, Beijing (CN); Guangquan He, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 106 days.

(21) Appl. No.: 15/564,335

(22) PCT Filed: Feb. 24, 2017

(86) PCT No.: PCT/CN2017/074763

§ 371 (c)(1),
(2) Date: Oct. 4, 2017

(87) PCT Pub. No.: WO2017/185871

PCT Pub. Date: Nov. 2, 2017

(65) Prior Publication Data

US 2018/0204531 A1 Jul. 19, 2018

(30) Foreign Application Priority Data

Apr. 28, 2016 (CN) ..... 2016 1 0278245

(51) Int. Cl.
*G09G 3/36* (2006.01)

(52) U.S. Cl.
CPC ..... *G09G 3/3614* (2013.01); *G09G 3/3607* (2013.01); *G09G 2300/0452* (2013.01);
(Continued)

(58) Field of Classification Search
CPC ... G09G 3/36–3696; G09G 2300/0439; G09G 2300/0452; G09G 2320/0209;
(Continued)

(56) References Cited

U.S. PATENT DOCUMENTS

2004/0169807 A1 9/2004 Rho et al.
2006/0202927 A1 9/2006 Lee
(Continued)

FOREIGN PATENT DOCUMENTS

CN 1806190 A 7/2006
CN 101211541 A 7/2008
(Continued)

OTHER PUBLICATIONS

International Search Report and Written Opinion dated May 27, 2017; PCT/CN2017/074763.
(Continued)

*Primary Examiner* — Nathan Danielsen

(57) ABSTRACT

A driving method of display panel, a display panel and a display device are disclosed. The driving method includes: in a single-frame display time, sequentially applying signals to a plurality of first sub-pixels connected to first data lines in a scanning direction so that: a signal polarity applied to each of a plurality of first white sub-pixels connected to first data lines is opposite to a signal polarity applied to a first sub-pixel which is located at an upstream of the first white sub-pixel along the scanning direction and is adjacent to the first white sub-pixel, and a signal polarity applied to each of
(Continued)

a plurality of first colored sub-pixels is identical with a signal polarity applied to a first sub-pixel which is located at an upstream of the first colored sub-pixel along the scanning direction and is adjacent to the first colored sub-pixel.

16 Claims, 9 Drawing Sheets

(52) U.S. Cl.
CPC ..... *G09G 2320/0209* (2013.01); *G09G 2320/0214* (2013.01); *G09G 2320/0252* (2013.01)

(58) Field of Classification Search
CPC .... G09G 2320/0214; G09G 2320/0252; G02F 1/133; G02F 1/133609; G02F 1/134309; G02F 2001/134345; G02F 2001/134354
See application file for complete search history.

(56) References Cited

U.S. PATENT DOCUMENTS

| | | | | |
|---|---|---|---|---|
| 2008/0150862 | A1 | 6/2008 | Tseng | |
| 2010/0328360 | A1 | 12/2010 | Miyashita | |
| 2015/0009112 | A1* | 1/2015 | Okumoto | G09G 3/3614 345/96 |
| 2015/0015623 | A1 | 1/2015 | Yang et al. | |
| 2015/0170590 | A1* | 6/2015 | Ahn | G09G 3/3614 345/96 |
| 2016/0056203 | A1 | 2/2016 | Kim et al. | |
| 2016/0071473 | A1 | 3/2016 | Ahn et al. | |
| 2016/0086552 | A1 | 3/2016 | Namkung et al. | |
| 2016/0365047 | A1 | 12/2016 | He et al. | |

FOREIGN PATENT DOCUMENTS

| | | | |
|---|---|---|---|
| CN | 101937142 | A | 1/2011 |
| CN | 103926775 | A | 7/2014 |
| CN | 104166263 | A | 11/2014 |
| CN | 104898317 | A | 9/2015 |
| CN | 105405416 | A | 3/2016 |
| CN | 105702226 | A | 6/2016 |
| KR | 1020070048515 | A | 5/2007 |

OTHER PUBLICATIONS

The First Chinese Office Action dated Oct. 11, 2017; Appln. 201610278245.X.

* cited by examiner

1

DRIVING METHOD OF DISPLAY PANEL, DISPLAY PANEL AND DISPLAY DEVICE

TECHNICAL FIELD

Embodiments of the present disclosure relate to a driving method of a display panel, a display panel and a display device.

BACKGROUND

In a high resolution display panel such as liquid crystal display (LCD) panel, the charge rate and the leakage current of pixel switches (e.g., TFTs) are key factors which may impose restriction on display effect with even higher resolution. Under the circumstance that the manufacturing method of TFTs in the display panel cannot be further developed, it may be difficult to mitigate the issue of poor display quality caused by manufacturing process. In driving circuits of the display panel, a positive polarity and a negative polarity of a pixel respectively represent different voltages, that is, a pixel voltage is a positive voltage or a negative voltage with relative to a common voltage. Generally, in order to increase the charge rate of the display panel, it may be possible to charge a certain row of pixels by normally turning on this row of gates and meanwhile pre-charging a next row or next several rows of pixels by simultaneously turning on a next row or next several rows of gates.

When a column reversal manner is adopted on data lines, that is, signals on the data lines have identical polarities in a single frame, if the leakage current of the pixel switch (e.g., TFT) is raised by backlight irradiation or increase of temperature, a cross-interference may be easily occurred between the row(s) of pixels being pre-charged and the row of pixels being normally charged. Such cross-interference is manifested as Crosstalk issue on the display panel. In order to mitigate the Crosstalk issue, existing technology adopts a Dot reversal manner; that is, using alternated, positive and negative signals in a single frame. The Dot reversal manner may significantly mitigate the Crosstalk issue. but the process of polarity reversal would cause problems such as decrease of charge rate and hence affect entire display brightness and increase power consumption.

SUMMARY

An embodiment of the present disclosure provides a driving method of display panel. The display panel includes first data lines and a plurality of sub-pixels of N colors arranged in rows and columns, N is an integer equal to or greater than 2, the plurality of sub-pixels includes a plurality of first sub-pixels connected to the first data lines, the plurality of first sub-pixels includes a plurality of first white sub-pixels and a plurality of first colored sub-pixels. The driving method includes: in a single-frame display time, sequentially applying signals to the plurality of first sub-pixels connected to the first data lines in a scanning direction so that: a signal polarity applied to each of the plurality of first white sub-pixels connected to the first data lines is opposite to a signal polarity applied to a first sub-pixel which is located at an upstream of the first white sub-pixel along the scanning direction and is adjacent to the first white sub-pixel, and a signal polarity applied to each of the plurality of first colored sub-pixels is identical with a signal polarity applied to a first sub-pixel which is located at an upstream of the first colored sub-pixel along the scanning direction and is adjacent to the first colored sub-pixel.

In an example, the display panel further includes second data lines, and none of sub-pixels connected to the second data lines is of white color. The driving method further includes: in the single-frame display time, respectively applying signals with identical polarities to second sub-pixels connected to the second data lines.

In an example, the sub-pixels of N colors are arranged to be cycled in every row, N is an integer greater than 3. The driving method further includes: in the single-frame display time, applying a signal to each of the sub-pixels in a first row located at the most upstream along the scanning direction in such a manner that: signal polarities of the plurality of sub-pixels in the first row are cycled with signal polarities of adjacent 2N sub-pixels as a period.

In an example, in a signal polarity cycle of the adjacent 2N sub-pixels, given that every adjacent two sub-pixels constitute one group, then signal polarities of the two sub-pixels in a same group are opposite to each other.

In an example, N is an even number. In a signal polarity cycle of the adjacent 2N sub-pixels, signal polarities of every two sub-pixels of a same color are identical with each other.

In an example, N is an even number. In a signal polarity cycle of the adjacent 2N sub-pixels, signal polarities of every two sub-pixels of a same color are opposite to each other.

Another embodiment of the present disclosure provides a display panel, the display panel includes: first data lines; a plurality of sub-pixels of N colors arranged in rows and columns, N is an integer greater or equal to 2, the plurality of sub-pixels includes a plurality of first sub-pixels connected to the first data lines, the plurality of first sub-pixels includes a plurality of first white sub-pixels and a plurality of colored sub-pixels; and a driving device configured to: in a single-frame display time, along a scanning direction, sequentially apply signals to the plurality of first sub-pixels connected to the first data lines in such a manner that: a signal polarity applied to each of the first white sub-pixels connected to the first data lines is opposite to a signal polarity applied to a first sub-pixel which is located at an upstream of the first white sub-pixel along the scanning direction and is adjacent to the first white sub-pixel, and a signal polarity applied to each of the first colored sub-pixels is identical with a signal polarity applied to a first sub-pixel which is located at an upstream of the first colored sub-pixel along the scanning direction and is adjacent to the first colored sub-pixel.

In an example, the display panel further includes second data lines, and none of sub-pixels connected to the second data lines is of white color. The driving device is further configured to: in the single-frame display time, respectively apply signals with identical polarities to second sub-pixels connected to the second data lines.

In an example, the sub-pixels of N colors are arranged to be cycled in every row, N is an integer greater than 3. The driving device is further configured to: in the single-frame display time, apply a signal to each of the sub-pixels in a first row located at the most upstream along the scanning direction in such a manner that: signal polarities of the plurality of sub-pixels in the first row are cycled with signal polarities of adjacent 2N sub-pixels as a period.

In an example, in a signal polarity cycle of the adjacent 2N sub-pixels, given that every adjacent two sub-pixels constitute one group, then signal polarities of the two sub-pixels in a same group are opposite to each other.

In an example, N is an even number. In a signal polarity cycle of the adjacent 2N sub-pixels, signal polarities of every two sub-pixels of a same color are identical with each other.

In an example, N is an even number. In a signal polarity cycle of the adjacent 2N sub-pixels, signal polarities of every two sub-pixels of a same color are opposite to each other.

In an example, sub-pixels of a same color in adjacent rows are spaced by locations of M sub-pixels, and M is an integer greater than 0 and smaller than N.

In an example, the N colors of the plurality of sub-pixels are white color, red color, green color and blue color, respectively; in adjacent rows, sub-pixels of a same color are spaced by locations of two sub-pixels.

In an example, the first data lines are located in gaps between adjacent two rows of sub-pixels, and the plurality of first sub-pixels connected to the first data lines are located in different rows and are located at both sides of the first data lines.

In an example, the first sub-pixels in odd columns are located at a right side of the first data lines, and the first sub-pixels in even columns are located at a left side of the first data lines, or the first sub-pixels in odd columns are located at a left side of the first data lines, and the first sub-pixels in even columns are located at a right side of the first data lines.

In an example, colors of the first colored sub-pixels connected to the first data lines are identical with each other.

Yet another embodiment of the present disclosure provides a display device including the display panel according to any of above examples.

BRIEF DESCRIPTION OF THE DRAWINGS

Hereafter, the embodiments of the present invention will be described in detail with reference to the drawings, so as to make one person skilled in the art understand the present invention more clearly.

DETAILED DESCRIPTION

Hereafter, the technical solutions in the embodiments of the present disclosure will be clearly, completely described with reference to the drawings in the embodiments of the present disclosure. Obviously, the embodiments described are only a part of the embodiments, not all embodiments. Based on the embodiments in the present disclosure, all other embodiments obtained by one skilled in the art without paying inventive labor are within the protection scope of the present disclosure.

Embodiments of the present disclosure provide a driving method of display panel, a display panel and a display device which can mitigate Crosstalk issue in the display panel while ensuring the display brightness.

For convenience of explanation, first of all, a display panel provided by an embodiment of the present disclosure will be described in view of the fact that the manner of polarity reversal in driving a display panel is related to an arrangement of pixels.

For example, an embodiment of the present disclosure provides a display panel including a plurality of sub-pixels arranged in rows and columns. The plurality of sub-pixels includes white (W) sub-pixels. For example, apart from white color, the sub-pixels in the display panel further include red color (R), green color (G) and blue color (B) as primary colors for generating white light. Of course, other colors such as yellow color (Y) are also possible.

For example, in the display panel provided by the embodiment of the present disclosure, the plurality of sub-pixels includes N colors, wherein N is an integer greater than 3. These sub-pixels of N colors are arranged to be cycled in every row. Given that the sub-pixels in the display panel include colors of RGBW, by way of example, these sub-pixels usually are grouped into several pixel units each constituted by RGBW sub-pixels which are arranged in a row direction, without excluding the possibility that these RGBW sub-pixels constituting a single pixel unit are arranged in two or more rows. Furthermore, RGBW (i.e., four) sub-pixels in a same row may be arranged in any manners without particularly defined herein, for example, the four sub-pixels may be arranged in an order of WRGB or in an order of RGWB, and the like.

For example, in the display panel provided by the embodiment of the present disclosure, sub-pixels of a same color in adjacent rows may be spaced by locations of M sub-pixels, M is an integer greater than 0 and smaller than N. Herein, "spaced by locations of M sub-pixels" may refer to shifting leftwards by locations of M sub-pixels, or shifting rightwards by locations of M sub-pixels, without particularly defined herein.

Figure 1:
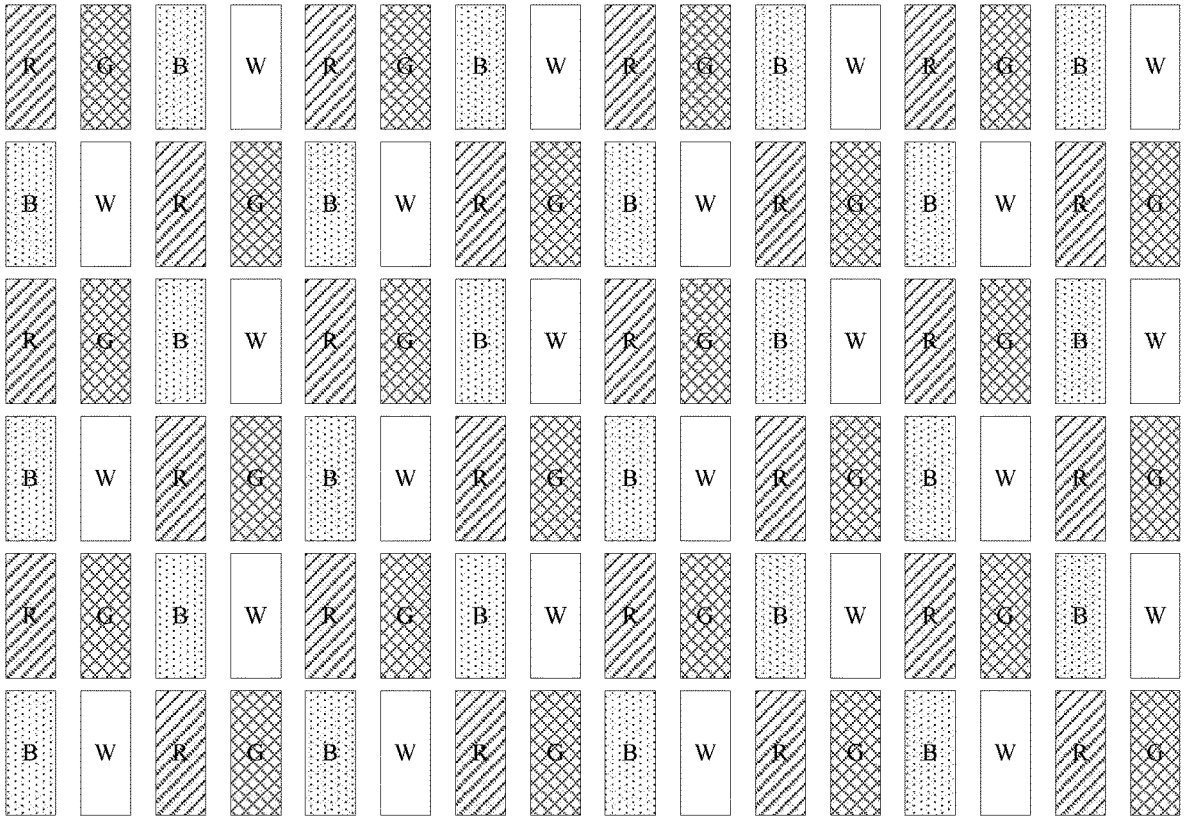
FIG. 1 is a schematic structural diagram of a display panel provided by an embodiment of the present disclosure.

For example, in the display panel provided by the embodiment of the present disclosure, as illustrated in FIG. 1, the plurality of sub-pixels may be white (W) sub-pixel, red (R) sub-pixel, green (G) sub-pixel and blue (B) sub-pixel; in adjacent rows, sub-pixels of the same color may be spaced by locations of two sub-pixels.

For example, the display panel provided by the embodiment of the present disclosure, usually, may further include a plurality of data lines arranged in gaps between columns of sub-pixels. For example, the plurality of data lines is connected to source electrodes of transistors in the plurality of sub-pixels. Connections between the data lines and the sub-pixels may be achieved by using a Normal structure, a Dual Gate structure or a Z-inversion structure, without particularly defined herein.

A Normal structure refers to a structure in which one data line is disposed at one side of each column of sub-pixels, and is connected to sub-pixels located at one side of the data line through a pixel switch for supplying the sub-pixels with signals.

A Dual Gate structure refers to a structure in which two gate lines are disposed in each of gaps between rows of sub-pixels; and one data line is disposed at each of gaps between columns of sub-pixels and is connected to sub-pixels at both sides of the gate line through a pixel switch. As compared to the Normal structure, the amount of data lines in the Dual Gate structure is reduced by one half while the amount of the gate lines is increased by one time.

In the Z-inversion structure, data lines are disposed in gaps between columns of sub-pixel, and each of the data lines is connected alternately to sub-pixels located at left and right sides of different rows. That is, a single data line is only connected to one sub-pixel in a same row in such a manner that it's connected to a sub-pixel located at the left side in one row and is connected to a sub-pixel located at the right side in another row. As compared to the Normal structure, the Z-inversion structure merely adds one data line. The Z-inversion structure is characterized in that it can realize Dot polarity reversal of the display panel to the largest extent on the premise of saving power and ensuring charge rate; that is, four sub-pixels located at upper, lower, left and right sides of any single sub-pixel always have a same polarity which is opposite to the sub-pixel at the center.

Figure 2A:
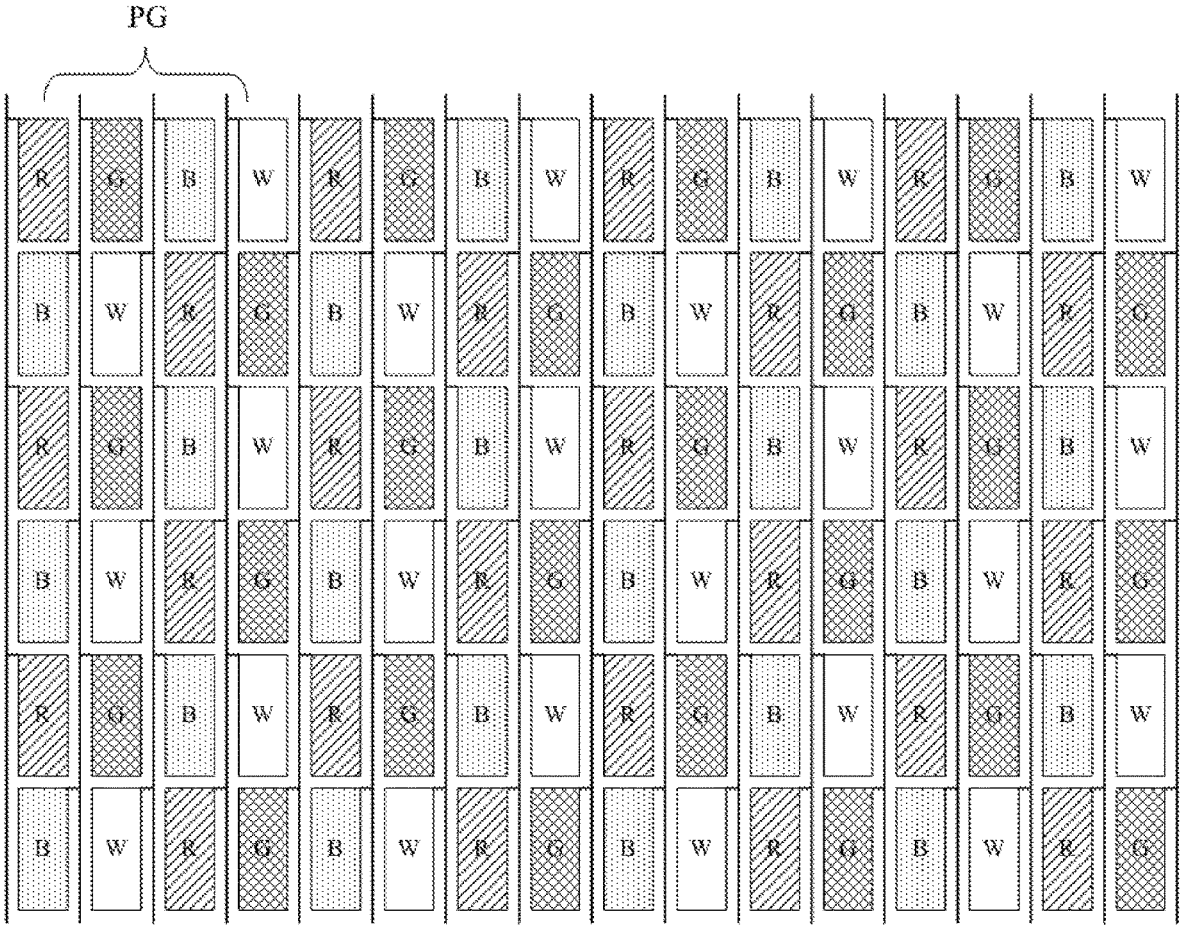
FIG. 2*a* and FIG. 2*b* are schematic diagrams illustrating data lines and sub-pixels which are connected by using a Z-inversion structure in the display panel provided by the embodiment of the present disclosure, respectively.

For example, in the above-mentioned display panel provided by the embodiment of the present disclosure, as illustrated in FIG. 2*a*, the connection between the data line and the sub-pixel may be achieved by the Z-inversion structure: the sub-pixels in odd columns are connected to the data line located at the left side of the sub-pixels, while the sub-pixels in even columns are connected to the data line located at the right side of the sub-pixels; that is, the sub-pixels connected to a same data line are arranged alternately in a rule of right, left, right, left and the like, along an up-down extending direction of the data line.

Figure 2B:
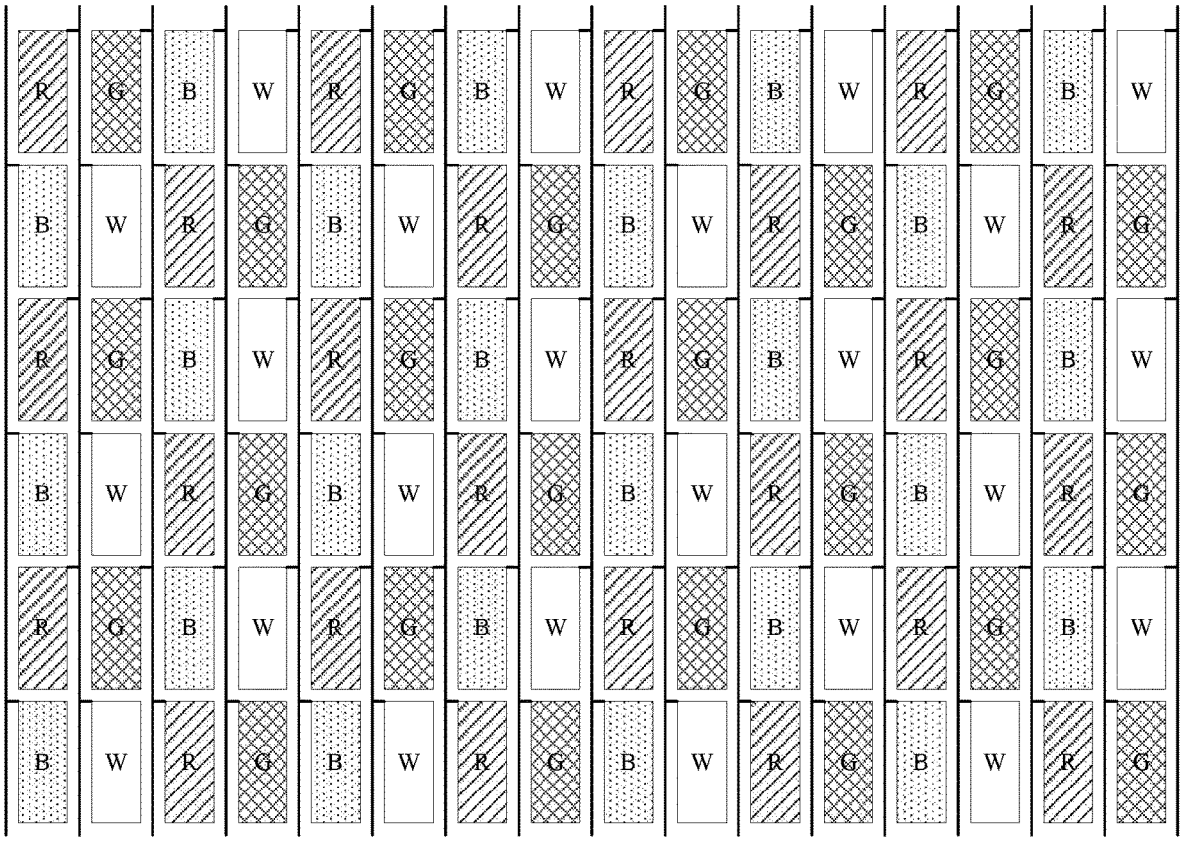

Alternatively, in the above-mentioned display panel provided by the embodiment of the present disclosure, as illustrated in FIG. 2*b*, the connection between the data line and the sub-pixel may be achieved by a reversed, Z-inversion structure: the sub-pixels in odd columns are connected to the data line located at the right side of the sub-pixels, while the sub-pixels in even columns are connected to the data line located at the left side of the sub-pixels; that is, the sub-pixels connected to a same data line are arranged alternately in a rule of left, right, left, right and the like, along the up-down extending direction of the data line.

The two types of Z-inversion structures are merely illustrated in FIG. 2*a* and FIG. 2*b* for purpose of explanation, without limiting the display panel provided by the embodiment of the present disclosure thereto.

Specific to the above-mentioned display panel including white sub-pixels provided by the embodiment of the present disclosure, a driving method of display panel is provided to include steps as below.

For example, in a single-frame display time, for first data lines connected to the white sub-pixels in the display panel: when applying signals to the white sub-pixels connected to the first data lines, signal polarities applied to the white sub-pixels connected to the first data lines are opposite to signal polarities applied to a last row of sub-pixels connected to the first data lines; when applying signals to other sub-pixels connected to the first data lines except the white sub-pixels, signal polarities applied to other sub-pixels connected to the first data lines except the white sub-pixels are identical with signal polarities applied to a last row of sub-pixels connected to the first data lines.

In the driving method of display panel provided by the embodiment of the present disclosure, for reducing the influence to the charge rate attributed to polarity reversal and meanwhile ensuring accurate and true color display of the sub-pixels, the polarity reversal is configured to be occurred on white sub-pixels but not occurred on sub-pixels having other colors. In this way, even if the charge rate of the white sub-pixels is decreased to some extent, it will barely influence the entire brightness of the display panel because the white sub-pixels have higher transmittance. This can mitigate the crosstalk issue in the display panel and meanwhile ensuring the display brightness.

For example, in the driving method of display panel provided by the embodiment of the present disclosure, depending on color arrangement of sub-pixels as well as connection relations between data lines and sub-pixels in the display panel, all the data lines may be connected to the white sub-pixels, or, part of the data lines may not be connected to the white sub-pixels.

For example, when the display panel contains data lines not connected to the white sub-pixels, the above-mentioned driving method of display panel provided by the embodiment of the present disclosure further includes: in a single-frame display time, for second data lines not connected to the white sub-pixels: applying signals with a same polarity to every row of sub-pixels connected to the second data lines; that is, by adopting a manner of column reversal. This ensures the charge rate and also saves power consumption. For example, in the Z-inversion structure illustrated in FIG. 2*a* and FIG. 2*b*, every four columns of data lines will contain two columns of data lines which are not connected to the white sub-pixels, then a column reversal will be performed on these two columns, while an alternated (positive or negative) polarity reversal will be occurred on the other two columns depending on the location of the white sub-pixels.

For example, when the display panel contains sub-pixels of N colors (N is an integer greater than 3) and when the sub-pixels of N colors are arranged to be cycled in every row, the above-mentioned driving method of display panel provided by the embodiment of the present disclosure further includes: signal polarities applied to the sub-pixels in a first row of sub-pixels are cycled with signal polarities applied to adjacent 2N sub-pixels as a period. For example, given that the sub-pixels of N colors in a same row on the display panel are grouped into a single pixel unit PG, then the signal polarities in the first row are cycled with the signal polarities of adjacent two pixel units as a period. For example, in the display panel, if a pixel unit is constituted by R sub-pixel (i.e., red sub-pixel), G sub-pixel (i.e., green sub-pixel), B sub-pixel (i.e., blue sub-pixel) and W sub-pixel (i.e., white sub-pixel), then the signal polarities in the first row are cycled with the signal polarities applied to eight sub-pixels as a period.

Figure 3A:
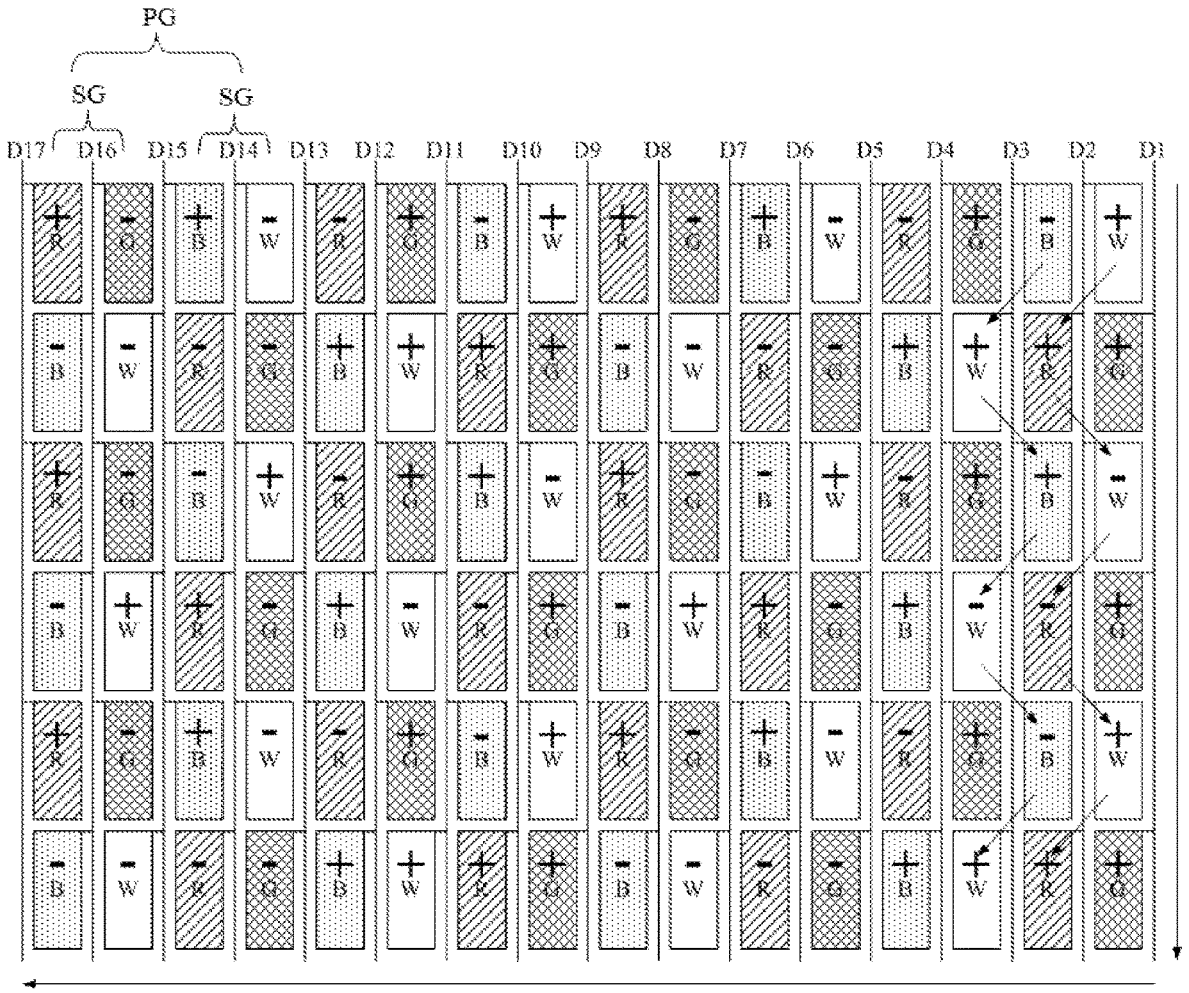
FIG. 3*a* and FIG. 3*b* are schematic diagrams illustrating signal polarities applied to the sub-pixels in a single-frame display time of the display panel provided by the embodiment of the present disclosure, respectively.

Furthermore, in the above-mentioned driving method of display panel provided by the embodiment of the present disclosure, when N is an even number, in a signal polarity cycle of the 2N sub-pixels, given that every two adjacent sub-pixels constitute a group SG, then the two sub-pixels in a same group have opposite signal polarities; and in a signal polarity cycle of the 2N sub-pixels, every two adjacent sub-pixels of a same color have identical signal polarities, or every two adjacent sub-pixels of a same color have opposite signal polarities. For example, when the display panel contains R sub-pixels, G sub-pixels, B sub-pixels and W sub-pixels, the signal polarities in the first row are cycled with the signal polarities applied to eight sub-pixels (RGBWRGBW) as a period. Among RGBW sub-pixels, as illustrated in FIG. 3*a*, a R sub-pixel and a G sub-pixel constitute a group SG; a B sub-pixel and a W sub-pixel constitute a group SG; the signal polarities of R sub-pixel and G sub-pixel are opposite to each other, and the signal polarities of B sub-pixel and W sub-pixel are opposite to each other. Given that every adjacent four RGBW sub-pixels in the first row are grouped to a pixel unit PG, then signal polarities of R sub-pixel, G sub-pixel, B sub-pixel and W sub-pixel in a first pixel unit PG are opposite to or identical with signal polarities of R sub-pixel, G sub-pixel, B sub-pixel and W sub-pixel in a second pixel unit, respectively. Herein, a first row refers to the first row of sub-pixels located at the most upstream along the scanning direction.

As above, the arrangement of signal polarities applied to the sub-pixels in the first row is merely described by way of example, and may be varied by signal inversion depending on actual designs, without going into details herein.

Hereinafter several specific embodiments of the driving method of display panel of the present disclosure will be described in more details with reference to the case where the connection relation between data lines and sub-pixels is a Z-inversion structure, by way of example.

The First Embodiment

Figure 3B:
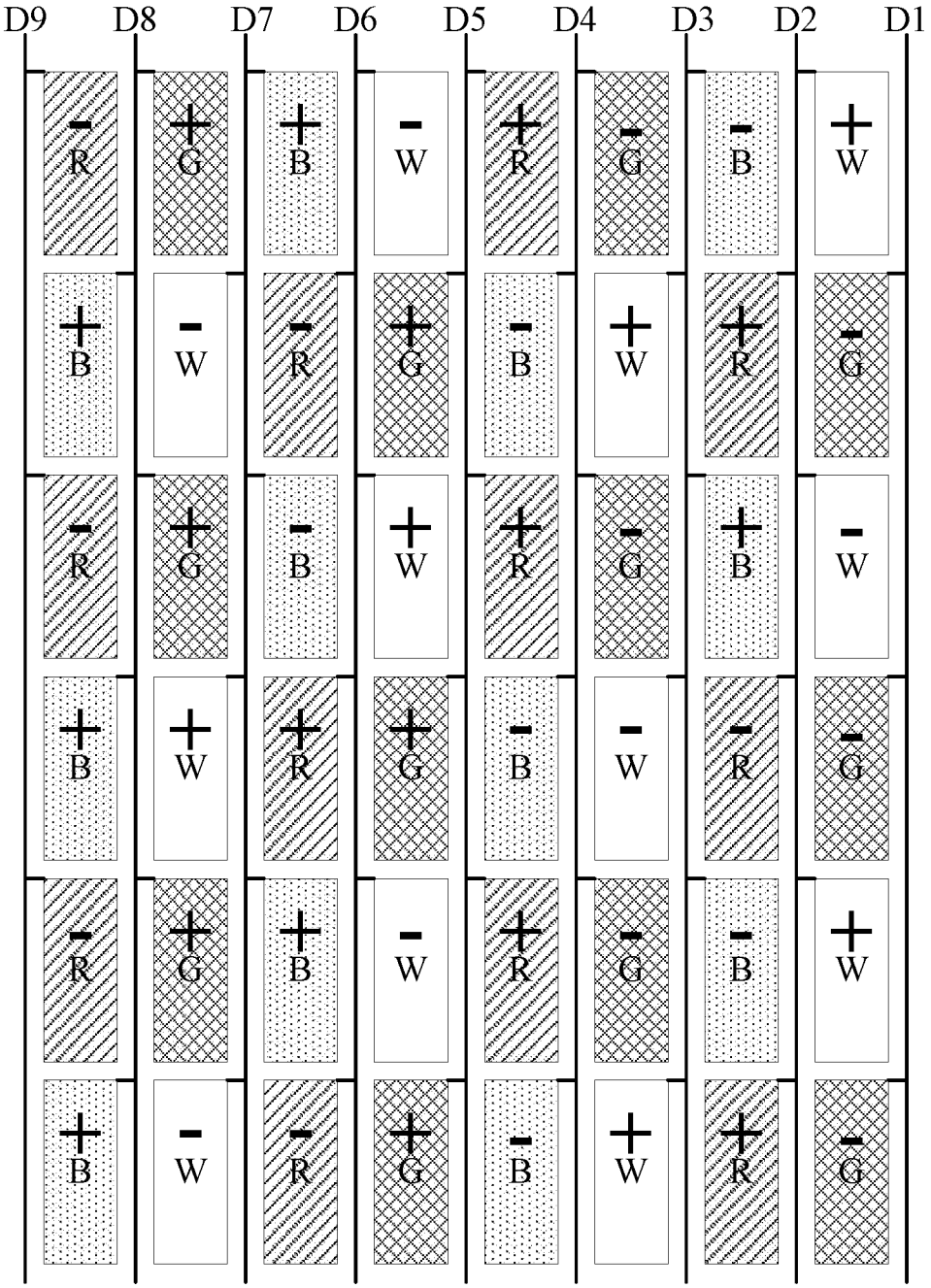

As illustrated in FIG. 3*a* and FIG. 3*b*, given that the R sub-pixel, G sub-pixel, B sub-pixel and W sub-pixel are connected to the data line by using a positive Z-inversion structure as illustrated in FIG. 2, then the signal polarities in the first row are cycled with the signal polarities applied to two pixel units PG as a period, and the sub-pixels of a same color in the two pixel units PG have opposite signal polarities; that is, the signal polarity of R sub-pixel in the first pixel unit PG is opposite to the signal polarity of R sub-pixel in the second pixel unit PG, the signal polarity of G sub-pixel in the first pixel unit PG is opposite to the signal polarity of G sub-pixel in the second pixel unit PG, the signal polarity of B sub-pixel in the first pixel unit PG is opposite to the signal polarity of B sub-pixel in the second pixel unit PG, and the signal polarity of W sub-pixel in the first pixel unit PG is opposite to the signal polarity of W sub-pixel in the second pixel unit PG.

For example, as illustrated in FIG. 3*a*, the signal polarities in the first row are cycled with "+−+−−+−+" as a period. A scanning direction of sub-pixels is directed from up to down as indicated by an arrow, while an arrangement direction of data lines is directed from right to left as indicated by another arrow. The data line of $(4n+1)t^h$ column (e.g., D1, D5, D9 and the like) is not connected to the white sub-pixels, and the signal polarities applied to the sub-pixels connected to this data line are identical with each other; The data line of $(4n+2)^{th}$ column (e.g., D2, D6, D10 and the like) is connected to the white sub-pixels, and the signal polarities applied to the sub-pixels connected to this data line are configured to be positive or negative in a 2Line polarity reversal manner (i.e., the signal polarities are reversed for one time every two rows); The data line of $(4n+3)^{th}$ column (e.g., D3, D7, D11 and the like) is connected to the white sub-pixels, and the signal polarities applied to the sub-pixels connected to this data line, except those in the first row, are configured to be positive or negative in a 1+2Line polarity-reversal manner (i.e., the signal polarities are reversed for one time every two rows); The data line of $(4n+4)^{th}$ column (e.g., D4, D8, D12 and the like) is not connected to the white sub-pixels, and the signal polarities applied to the sub-pixels connected to this data line are identical with each other. Herein, n is an integer greater than or equal to 0. For example, the signal polarities applied to the sub-pixels connected to data lines D1 and D4 are all positive; the signal polarities applied to the sub-pixels connected to data lines D5 and D8 are all negative; and the signal polarities applied to the white sub-pixels connected to data lines D2, D3, D6 and D7 are opposite to the signal polarities applied to the sub-pixels in a last row connected to these data lines. As it can be seen, among sub-pixels in a same row, the signal polarities applied to two sub-pixels connected to data lines D1 and D5 are opposite to each other; the signal polarities applied to two sub-pixels connected to data lines D4 and D8 are opposite to each other; the signal polarities applied to two sub-pixels connected to data lines D2 and D6 are opposite to each other; and the signal polarities applied to two sub-pixels connected to data lines D3 and D7 are opposite to each other. Herein, the data line connected to the white sub-pixels is referred to as the first data line; while the data line not connected to any white sub-pixel is referred to as the second data line. The sub-pixels connected to the first data line are referred to as the first sub-pixels; while the sub-pixels connected to the second data line are referred to as the second sub-pixels. The first sub-pixels may include a first white sub-pixel and a first colored sub-pixel. That is to say, in a single-frame display time, along the scanning direction, sequentially applying signals to a plurality of first sub-pixels connected to first data lines (e.g., data line D2, D3, D6 and D7) in such a manner that: a signal polarity applied to each of the first white sub-pixels connected to the first data lines is opposite to a signal polarity applied to a first sub-pixel which is located at an upstream of the first white sub-pixel along the scanning direction and is adjacent to the first white sub-pixel, and a signal polarity applied to each of the first colored sub-pixels is identical with a signal polarity applied to a first sub-pixel which is located at an upstream of the first colored sub-pixel along the scanning direction and is adjacent to the first colored sub-pixel. In the single-frame display time, applying signals with identical polarities to all the second sub-pixels connected to the second data lines (e.g., data line D1, D4, D5 and D8). In this way, when the data driver IC performs charge sharing, the $(4n+1)^{th}$ column with n being an odd number and the the $(4n+1)^{th}$ column with n being an even number may share a pair of operational amplifiers (OPs) with negative polarity and positive polarity respectively; the $(4n+2)^{th}$ column with n being an odd number and the the $(4n+2)^{th}$ column with n being an even number may share a pair of operational amplifiers (OPs) with negative polarity and positive polarity respectively; the $(4n+3)^{th}$ column with n being an odd number and the the $(4n+3)^{th}$ column with n being an even number may share a pair of operational amplifiers (OPs) with negative polarity and positive polarity respectively; the $(4n+4)^{th}$ column with n being an odd number and the the $(4n+4)^{th}$ column with n being an even number may share a pair of operational amplifiers (OPs) with negative polarity and positive polarity respectively.

For example, as illustrated FIG. 3*b*, the signal polarities in the first row are cycled with "+−−+−++−" as a period. The data line of $(4n+1)^{th}$ column is not connected to any white sub-pixel, and the signal polarities applied to the sub-pixels connected to this data line are identical with each other; The data line of $(4n+2)^{th}$ column is connected to the white sub-pixels, and the signal polarities applied to the sub-pixels connected to this data line are configured to be positive or negative in a 2Line polarity reversal manner (i.e., the signal polarities are reversed for one time every two rows); The data line of $(4n+3)^{th}$ column is connected to the white sub-pixels, and the signal polarities applied to the sub-pixels connected to this data line, except those in the first row, are configured to be positive or negative in a 1+2Line polarity reversal manner (i.e., the signal polarities are reversed for one time every two rows); The data line of $(4n+4)^{th}$ column is not connected to any white sub-pixel, and the signal polarities applied to the sub-pixels connected to this data line are identical with each other. For example, the signal polarities applied to the sub-pixels connected to data lines D1 and D4 are negative; the signal polarities applied to the sub-pixels connected to data lines D5 and D8 are positive; and signal polarities applied to the white sub-pixels connected to data lines D2, D3, D6 and D7 are opposite to the signal polarities applied to the sub-pixels in a last row connected to these data lines. As it can be seen, among sub-pixels in a same row, the signal polarities applied to the sub-pixels connected to data lines D1 and D5 are opposite to each other; the signal polarities applied to the sub-pixels connected to data lines D4 and D8 are opposite to each other; the signal polarities applied to the sub-pixels connected to data lines D2 and D6 are opposite to each other; and the signal polarities applied to the sub-pixels connected to data lines D3 and D7 are opposite to each other. In this way, when the data driver IC performs charge sharing, the $(4n+1)^{th}$ column with n being an odd number and the the $(4n+1)^{th}$ column with n being an even number may share a pair of operational amplifiers (OPs) with negative polarity and positive polarity respectively; the $(4n+2)^{th}$ column with n being an odd number and the the $(4n+2)^{th}$ column with n being an even number may share a pair of operational amplifiers (OPs) with negative polarity and positive polarity respectively; the $(4n+3)^{th}$ column with n being an odd number and the the $(4n+3)^{th}$ column with n being an even number may share a pair of operational amplifiers (OPs) with negative polarity and positive polarity respectively; the $(4n+4)^{th}$ column with n being an odd number and the the $(4n+4)^{th}$ column with n being an even number may share a pair of operational amplifiers (OPs) with negative polarity and positive polarity respectively.

The Second Embodiment

Figure 3C:
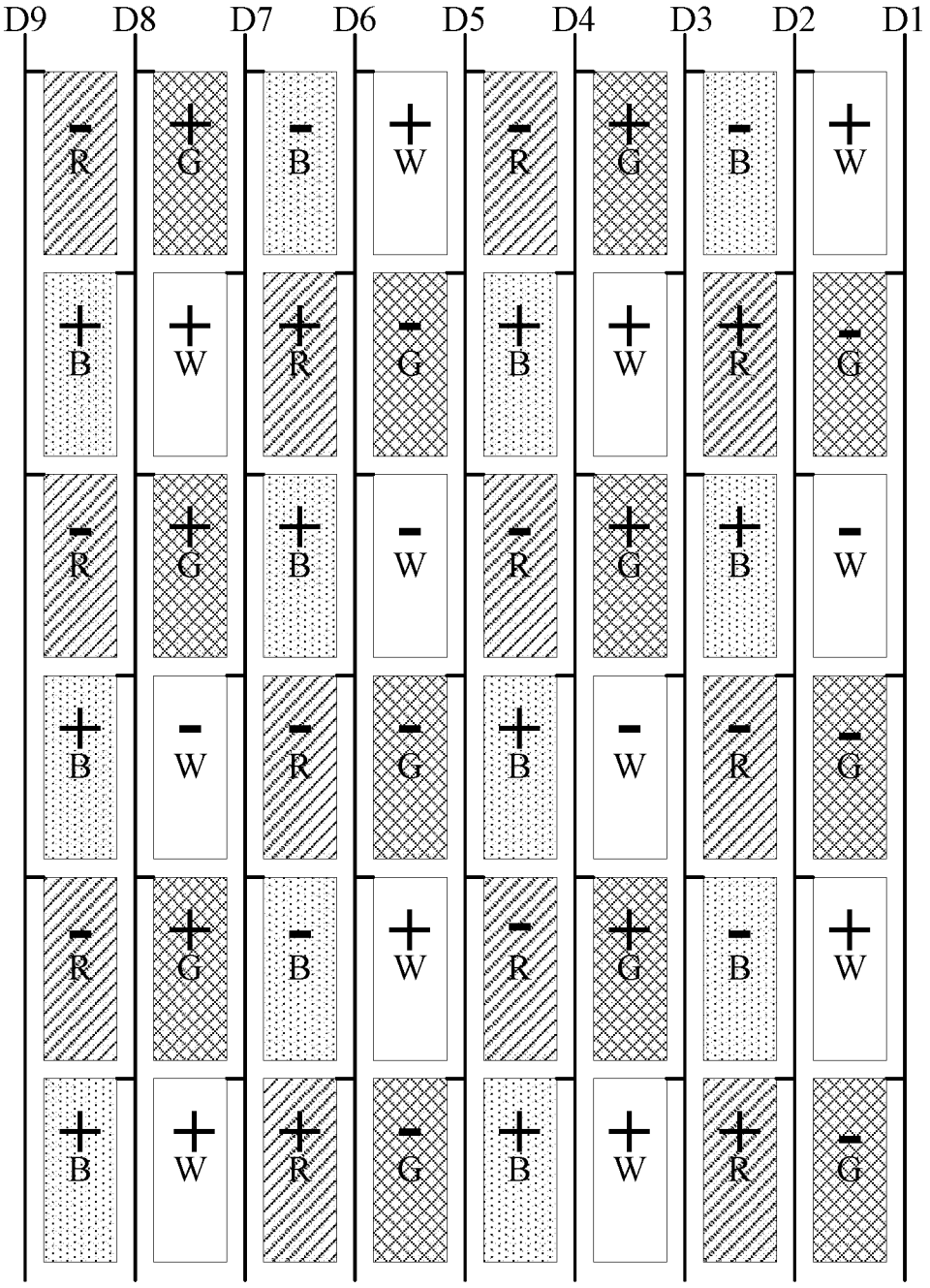
FIG. 3*c* and FIG. 3*d* are schematic diagrams illustrating signal polarities applied to the sub-pixels in a single-frame display time of the display panel provided by the embodiment of the present disclosure, respectively.
Figure 3D:
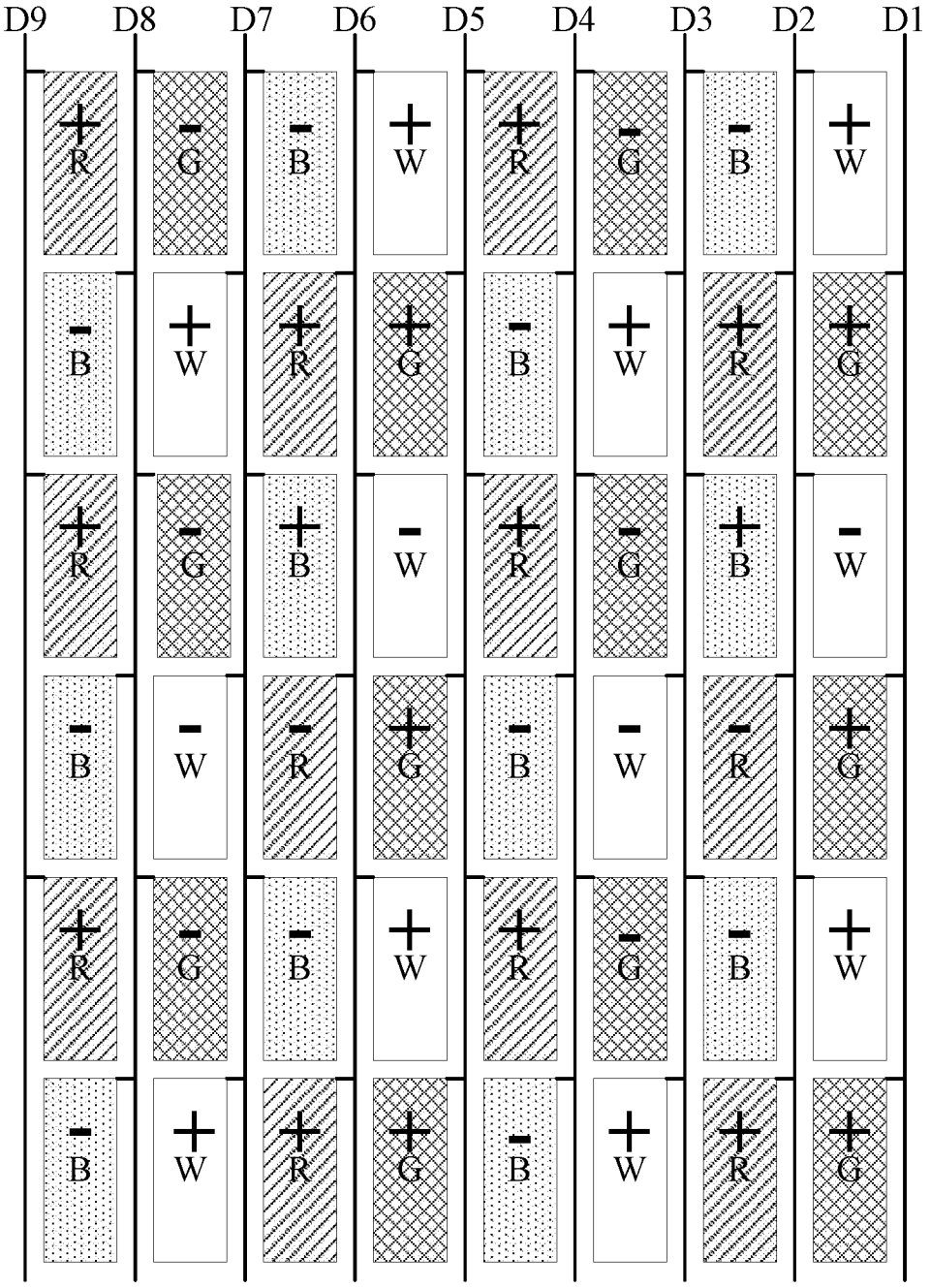

As illustrated in FIG. 3*c* and FIG. 3*d*, given that the R sub-pixel, G sub-pixel, B sub-pixel and W sub-pixel are connected to the data line by using a positive Z-inversion structure, then the signal polarities in the first row are cycled with the signal polarities applied to two pixel units PG as a period, and signal polarities applied to the sub-pixels of a same color in the two pixel units PG are identical with each other; that is, the signal polarity of R sub-pixel in the first pixel unit PG is identical with the signal polarity of R sub-pixel in the second pixel unit PG, the signal polarity of G sub-pixel in the first pixel unit PG is identical with the signal polarity of G sub-pixel in the second pixel unit PG, the signal polarity of B sub-pixel in the first pixel unit PG is identical with the signal polarity of B sub-pixel in the second pixel unit PG, and the signal polarity of W sub-pixel in the first pixel unit PG is identical with the signal polarity of W sub-pixel in the second pixel unit PG.

For example, as illustrated FIG. 3*c*, the signal polarities in the first row are cycled with "+−+−+−+−" as a period. The data line of $(4n+1)^{th}$ column is not connected to any white sub-pixel, and the signal polarities applied to the sub-pixels connected to this data line are identical with each other; The data line of $(4n+2)^{th}$ column is connected to the white sub-pixels, and the signal polarities applied to the sub-pixels connected to this data line are configured to be positive or negative in a 2Line polarity reversal manner (i.e., the signal polarities are reversed for one time every two rows); The data line of $(4n+3)^{th}$ column is connected to the white sub-pixels, and the signal polarities applied to the sub-pixels connected to this data line, except those in the first row, are configured to be positive or negative in a 1+2Line polarity reversal manner (i.e., the signal polarities are reversed for one time every two rows); The data line of $(4n+4)^{th}$ column is not connected to any white sub-pixel, and the signal polarities applied to the sub-pixels connected to this data line are identical with each other. For example, the signal polarities applied to the sub-pixels connected to data lines D1 and D5 are all negative; the signal polarities applied to the sub-pixels connected to data lines D4 and D8 are all positive; and the signal polarities applied to the white sub-pixels connected to data lines D2, D3, D6 and D7 are opposite to the signal polarities applied to the sub-pixels in a last row connected to these data lines. As it can be seen, among sub-pixels in a same row, the signal polarities applied to the two sub-pixels connected to data lines D1 and D4 are opposite to each other; the signal polarities applied to the two sub-pixels connected to data lines D5 and D8 are opposite to each other; the signal polarities applied to the two sub-pixels connected to data lines D2 and D6 are identical with each other; and the signal polarities applied to the two sub-pixels connected to data lines D3 and D7 are identical with each other. In this way, when the data driver IC performs charge sharing, the $(4n+1)^{th}$ column and the $(4n+4)^{th}$ column may share a pair of operational amplifiers (OPs) with negative polarity and positive polarity respectively; the $(4n+2)^{th}$ column may independently utilize a pair of operational amplifiers (OPs) with negative polarity and positive polarity respectively; and the $(4n+3)^{th}$ column may independently utilize a pair of operational amplifiers (OPs) with negative polarity and positive polarity respectively.

For example, as illustrated FIG. 3*d*, the signal polarities in the first row are cycled with "+−−++−−+" as a period. The data line of $(4n+1)^{th}$ column is not connected to any white sub-pixel, and the signal polarities applied to the sub-pixels connected to this data line are identical with each other; The data line of $(4n+2)^{th}$ column is connected to the white sub-pixels, and the signal polarities applied to the sub-pixels connected to this data line are configured to be positive or negative in a 2Line polarity reversal manner (i.e., the signal polarities are reversed for one time every two rows); The data line of $(4n+3)^{th}$ column is connected to the white sub-pixels, and the signal polarities applied to the sub-pixels connected to this data line, except those in the first row, are configured to be positive or negative in a 1+2Line polarity reversal manner (i.e., the signal polarities are reversed for one time every two rows); The data line of $(4n+4)^{th}$ column is not connected to any white sub-pixel, and the signal polarities applied to the sub-pixels connected to this data line are identical with each other. For example, the signal polarities applied to the sub-pixels connected to data lines D1 and D5 are all positive; the signal polarities applied to the sub-pixels connected to data lines D4 and D8 are all negative; and the signal polarities applied to the white sub-pixels connected to data lines D2, D3, DC and D7 are opposite to the signal polarities applied to the sub-pixels in a last row connected to these data lines. As it can be seen, among sub-pixels in a same row, the signal polarities applied to the two sub-pixels connected to data lines D1 and D4 are opposite to each other; the signal polarities applied to the two sub-pixels connected to data lines D5 and D8 are opposite to each other; the signal polarities applied to the two sub-pixels connected to data lines D2 and D6 are identical with each other; and the signal polarities applied to the two sub-pixels connected to data lines D3 and D7 are identical with each other. In this way, when the data driver IC performs charge sharing, the $(4n+1)^{th}$ column and the $(4n+4)^{th}$ column may share a pair of operational amplifiers (OPs) with negative polarity and positive polarity respectively; the $(4n+2)^{th}$ column may independently utilize a pair of operational amplifiers (OPs) with negative polarity and positive polarity respectively; and the $(4n+3)^{th}$ column may independently utilize a pair of operational amplifiers (OPs) with negative polarity and positive polarity respectively.

The Third Embodiment

Figure 3E:
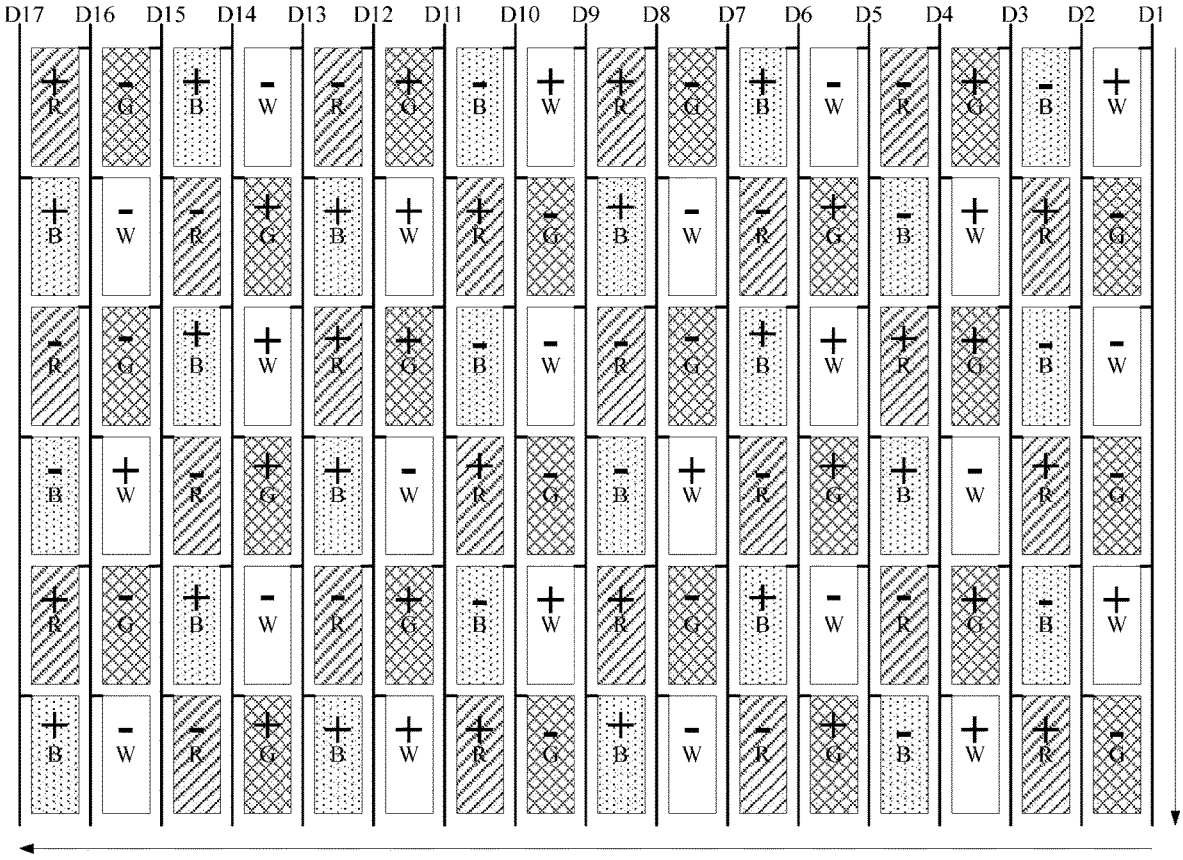
FIG. 3*e* is a schematic diagram illustrating signal polarities applied to the sub-pixels in a single-frame display time of the display panel provided by the embodiment of the present disclosure.
Figure 4:
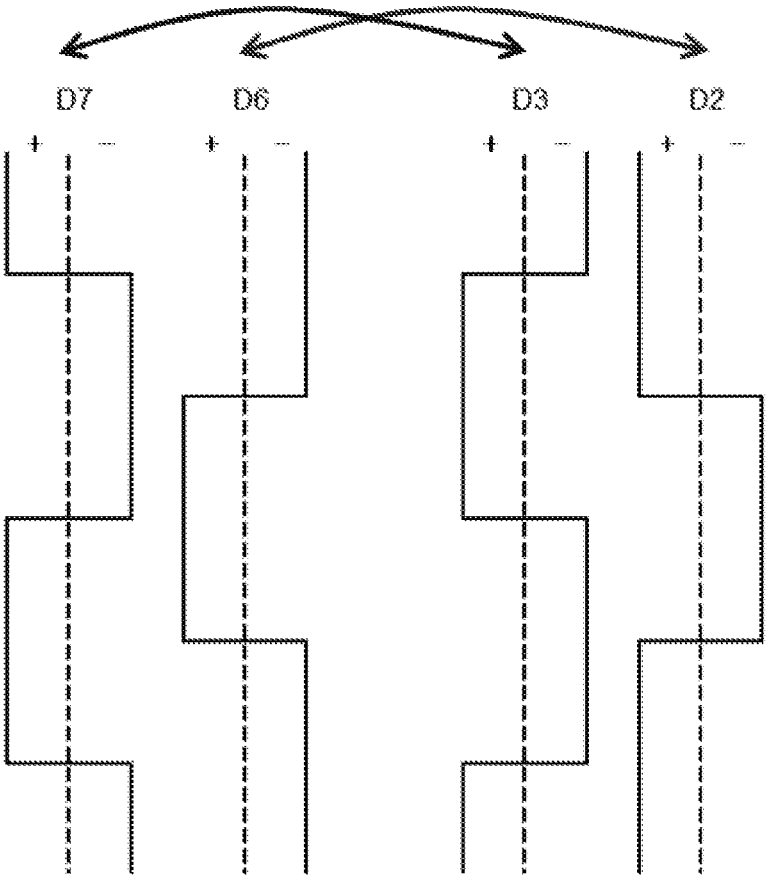
FIG. 4 is a schematic diagram illustrating a polarity reversal in FIG. 3*a*.

As illustrated in FIG. 3*e*, given that the R sub-pixel, G sub-pixel, B sub-pixel and W sub-pixel are connected to the data line by using a reversed, Z-inversion structure as illustrated in FIG. 2*b*, then the signal polarities in the first row are cycled with the signal polarities applied to two pixel units PG as a period, and the signal polarities applied to the sub-pixels of a same color in the two pixel units PG are opposite to each other; that is, the signal polarity of R sub-pixel in the first pixel unit PG is opposite to the signal polarity of R sub-pixel in the second pixel unit PG, the signal polarity of G sub-pixel in the first pixel unit PG is opposite to the signal polarity of G sub-pixel in the second pixel unit PG, the signal polarity of B sub-pixel in the first pixel unit PG is opposite to the signal polarity of B sub-pixel in the second pixel unit PG, and the signal polarity of W sub-pixel in the first pixel unit PG is opposite to the signal polarity of W sub-pixel in the second pixel unit PG.

For example, as illustrated FIG. 3*e*, the signal polarities in the first row are cycled with "+−+−−+−+" as a period. A scanning direction of sub-pixels is directed from up to down as indicated by an arrow, while an arrangement direction of data lines is directed from right to left as indicated by another arrow. The data line of $(4n+1)^{th}$ column is connected to white sub-pixels, and the signal polarities applied to the sub-pixels connected to this data line are configured to be positive or negative in a 2Line polarity reversal manner (i.e., the signal polarities are reversed for one time every two rows); The data line of $(4n+2)^{th}$ column is not connected to any white sub-pixel, and the signal polarities applied to the sub-pixels connected to this data line are identical with each other; The data line of $(4n+3)^{th}$ column is not connected to any white sub-pixel, and the signal polarities applied to the sub-pixels connected to this data line are identical with each other; The data line of $(4n+4)^{th}$ column is connected to the white sub-pixels, and the signal polarities applied to the sub-pixels connected to this data line, except those in the first row, are configured to be positive or negative in a 1+2Line polarity reversal manner (i.e., the signal polarities are reversed for one time every two rows). For example, the signal polarities applied to the sub-pixels connected to data lines D3 and D6 are all positive; the signal polarities applied to the sub-pixels connected to data lines D2 and D7 are all negative; and the signal polarities applied to the white sub-pixels connected to data lines D1, D4, D5 and D8 are opposite to the signal polarities applied to the sub-pixels in a last row connected to these data lines. As it can be seen, among sub-pixels in a same row, the signal polarities applied to the two sub-pixels connected to data lines D1 and D5 are opposite to each other; the signal polarities applied to the two sub-pixels connected to data lines D2 and D6 are opposite to each other; the signal polarities applied to the two sub-pixels connected to data lines D3 and D7 are opposite to each other; and the signal polarities applied to the two sub-pixels connected to data lines D4 and D8 are opposite to each other. In this way, when the data driver IC performs charge sharing, the $(4n+1)^{th}$ column with n being an odd number and the the $(4n+1)^{th}$ column with n being an even number may share a pair of operational amplifiers (OPs) with negative polarity and positive polarity respectively; the $(4n+4)^{th}$ column with n being an odd number and the the $(4n+4)^{th}$ column with n being an even number may share a pair of operational amplifiers (OPs) with negative polarity and positive polarity respectively; the $(4n+2)^{th}$ column with n being an odd number and the the $(4n+2)^{th}$ column with n being an even number may share a pair of operational amplifiers (OPs) with negative polarity and positive polarity respectively; the $(4n+3)^{th}$ column with n being an odd number and the the $(4n+3)^{th}$ column with n being an even number may share a pair of operational amplifiers (OPs) with negative polarity and positive polarity respectively.

It should be noted that: throughout the drawings of the present disclosure, each of the rectangular boxes in FIGS. 1-3*e* denotes a single sub-pixel unit; the letter in each of the rectangular boxes such as R, G, B and W indicates that a color of the sub-pixel is red, green, blue and white, respectively; the symbol in each of the rectangular boxes such as "+" and "−" indicates that the signal polarity applied to this sub-pixel unit is positive and negative, respectively.

Figure 5:
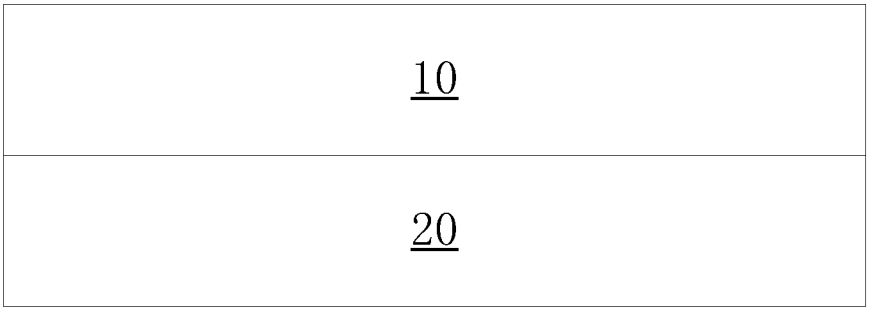
FIG. 5 is a schematic diagram illustrating a display device provided by embodiment of the present disclosure.

Based on the same inventive concept, the embodiment of the present disclosure further provides a display device including the display panel provided by any of the foregoing embodiments. The display device may be any product or component having display function such as mobile phone, tablet computer, TV set, displayer, notebook computer, digital photo frame and navigator. As for the implementations of the display device, reference may be made to the foregoing embodiments of the display panel. In case that the display device provided by the embodiment of the present disclosure is a liquid crystal device (LCD) 1, apart from the above-mentioned display panel 10, the display device may further include a backlight source unit 20 configured to supply the display panel 10 with a light source, as illustrated in FIG. 5.

In the driving method of display panel, the display panel and the display device provided by the embodiment of the present disclosure, the display panel contains white sub-pixels; in a single-frame display time, for first data lines connected to the white sub-pixels in the display panel: when applying signals to the white sub-pixels connected to the first data lines, signal polarities applied to the white sub-pixels connected to the first data lines are opposite to signal polarities applied to a last row of sub-pixels connected to the first data lines; when applying signals to other sub-pixels connected to the first data lines except the white sub-pixels, signal polarities applied to other sub-pixels connected to the first data lines except the white sub-pixels are identical with signal polarities applied to a last row of sub-pixels connected to the first data lines. In the driving method of display panel provided by the embodiment of the present disclosure, for reducing the influence to the charge rate attributed to polarity reversal and meanwhile ensuring accurate and true color display of the sub-pixels, the polarity reversal is configured to be occurred on white sub-pixels but not occurred on sub-pixels having other colors. In this way, even if the charge rate of the white sub-pixels is decreased to some extent, it will barely influence the entire brightness of the display panel because the white sub-pixels have higher transmittance. This can mitigate the crosstalk issue in the display panel and meanwhile ensuring the display brightness The foregoing are merely specific embodiments of the invention, but not limitative to the protection scope of the invention. Within the technical scope disclosed by the present disclosure, any alternations or replacements which can be readily envisaged by one skilled in the art shall be within the protection scope of the present disclosure. Therefore, the protection scope of the invention shall be defined by the accompanying claims.

The present invention claims the benefits of Chinese patent application No. 201610278245.X, which was filed with the SIPO on Apr. 28, 2016 and is fully incorporated herein by reference as part of this application.

What is claimed is:

1. A driving method of a display panel, the display panel comprising first data lines and a plurality of sub-pixels of N colors arranged in rows and columns, N being an integer equal to or greater than 2, the plurality of sub-pixels comprising a plurality of first sub-pixels connected to the first data lines, the plurality of first sub-pixels comprising a plurality of first white sub-pixels and a plurality of first colored sub-pixels, wherein the driving method comprises:

applying signals to the plurality of first sub-pixels connected to the first data lines in a scanning direction sequentially in a single-frame display time, so that: a signal polarity applied to each of the plurality of first white sub-pixels connected to the first data lines is opposite to a signal polarity applied to a first sub-pixel which is located at an upstream of the first white sub-pixel along the scanning direction and is adjacent to the first white sub-pixel, and a signal polarity applied to each of the plurality of first colored sub-pixels is identical with a signal polarity applied to a first sub-pixel which is located at an upstream of the first colored sub-pixel along the scanning direction and is adjacent to the first colored sub-pixel, wherein the display panel further comprises second data lines, and none of sub-pixels connected to the second data lines is of white color, the driving method further comprises:

in the single-frame display time, respectively applying signals with identical polarities to second sub-pixels connected to the second data lines.

2. The driving method of display panel according to claim 1, wherein the sub-pixels of N colors are arranged to be cycled in every row, N is an integer greater than 3, the driving method further comprises:

in the single-frame display time, applying a signal to each of the sub-pixels in a first row located at the most upstream along the scanning direction in such a manner that: signal polarities of the plurality of sub-pixels in the first row are cycled with signal polarities of adjacent 2N sub-pixels as a period.

3. The driving method of display panel according to claim 2, wherein N is an even number, and in a signal polarity cycle of the adjacent 2N sub-pixels, given that every adjacent two sub-pixels constitute one group, then signal polarities of the two sub-pixels in a same group are opposite to each other.

4. The driving method of display panel according to claim 2, wherein N is an even number, in a signal polarity cycle of the adjacent 2N sub-pixels, signal polarities of every two sub-pixels of a same color are identical with each other.

5. The driving method of display panel according to claim 2, wherein N is an even number, in a signal polarity cycle of the adjacent 2N sub-pixels, signal polarities of every two sub-pixels of a same color are opposite to each other.

6. A display panel, comprising:

first data lines;

a plurality of sub-pixels of N colors arranged in rows and columns, N being an integer greater or equal to 2, the plurality of sub-pixels comprising a plurality of first sub-pixels connected to the first data lines, the plurality of first sub-pixels comprising a plurality of first white sub-pixels and a plurality of colored sub-pixels; and a driving device configured to: in a single-frame display time, along a scanning direction, sequentially apply signals to the plurality of first sub-pixels connected to the first data lines in such a manner that: a signal polarity applied to each of the first white sub-pixels connected to the first data lines is opposite to a signal polarity applied to a first sub-pixel which is located at an upstream of the first white sub-pixel along the scanning direction and is adjacent to the first white sub-pixel, and a signal polarity applied to each of the first colored sub-pixels is identical with a signal polarity applied to a first sub-pixel which is located at an upstream of the first colored sub-pixel along the scanning direction and is adjacent to the first colored sub-pixel, the display panel further comprising second data lines, wherein none of sub-pixels connected to the second data lines is of white color, the driving device is further configured to:

in the single-frame display time, respectively apply signals with identical polarities to second sub-pixels connected to the second data lines.

7. The display panel according to claim 6, wherein the sub-pixels of N colors are arranged to be cycled in every row, N is an integer greater than 3, the driving device is further configured to:

in the single-frame display time, apply a signal to each of the sub-pixels in a first row located at the most upstream along the scanning direction in such a manner that: signal polarities of the plurality of sub-pixels in the first row are cycled with signal polarities of adjacent 2N sub-pixels as a period.

8. The display panel according to claim 7, wherein in a signal polarity cycle of the adjacent 2N sub-pixels, given that every adjacent two sub-pixels constitute one group, then signal polarities of the two sub-pixels in a same group are opposite to each other.

9. The display panel according to claim 8, wherein N is an even number, in a signal polarity cycle of the adjacent 2N sub-pixels, signal polarities of every two sub-pixels of a same color are identical with each other.

10. The display panel according to claim 8, wherein N is an even number, in a signal polarity cycle of the adjacent 2N sub-pixels, signal polarities of every two sub-pixels of a same color are opposite to each other.

11. The display panel according to claim 7, wherein sub-pixels of a same color in adjacent rows are spaced by locations of M sub-pixels, wherein M is an integer greater than 0 and smaller than N.

12. The display panel according to claim 6, wherein the N colors of the plurality of sub-pixels are white color, red color, green color and blue color, respectively, in adjacent rows, sub-pixels of a same color are spaced by locations of two sub-pixels.

13. The display panel according to claim 6, wherein the first data lines are located in gaps between adjacent two rows of sub-pixels, and the plurality of first sub-pixels connected to the first data lines are located in different rows and are located at both sides of the first data lines.

14. The display panel according to claim 13, wherein the first sub-pixels in odd columns are located at a right side of the first data lines, and the first sub-pixels in even columns are located at a left side of the first data lines, or the first sub-pixels in odd columns are located at a left side of the first data lines, and the first sub-pixels in even columns are located at a right side of the first data lines.

15. The display panel according to claim 6, wherein colors of the first colored sub-pixels connected to the first data lines are identical with each other.

16. A display device, comprising the display panel according to claim 6.

* * * * *